US005717775A

United States Patent [19]

Sakamoto et al.

[11] Patent Number: 5,717,775

[45] Date of Patent: Feb. 10, 1998

[54] VOICE COIL AND LOUDSPEAKER STRUCTURE

[75] Inventors: Yoshio Sakamoto, Hachioji; Itsuki Kawabata, Tokorozawa, both of Japan

[73] Assignee: Kabushiki Kaisha Kenwood, Tokyo, Japan

[21] Appl. No.: 227,874

[22] Filed: Apr. 15, 1994

[30] Foreign Application Priority Data

Apr. 19, 1993 [JP] Japan ..... 5-091300

[51] Int. Cl.[6] ..... H04R 25/00

[52] U.S. Cl. ..... 381/194; 381/199; 381/195

[58] Field of Search ..... 381/194, 199, 381/201, 195, 196

[56] References Cited

U.S. PATENT DOCUMENTS

| | | | |
|---|---|---|---|
| 3,201,529 | 8/1965 | Surh | 381/199 |
| 5,091,028 | 2/1992 | Yamazaki et al. | 381/194 |
| 5,091,958 | 2/1992 | Sakamoto et al. | 381/194 |

FOREIGN PATENT DOCUMENTS

| | | |
|---|---|---|
| 0112559 | 4/1984 | European Pat. Off. . |
| 0377143 | 11/1990 | European Pat. Off. . |
| 0382996 | 4/1991 | Japan . |

*Primary Examiner*—Sinh Tran

*Attorney, Agent, or Firm*—Sixbey, Friedman, Leedom & Ferguson; Gerald J. Ferguson, Jr.; Eric J. Robinson

[57] ABSTRACT

A volume ratio of conductive material to a voice coil is improved by using a tape coil wire, and a magnetic efficiency of the voice coil is improved by attaching magnetic material to conductive material of the coil wire. A tape coil wire having a predetermined width is wound about a voice coil bobbin to form a voice coil. The winding start portion of the voice coil is soldered to the exposed area of the voice coil bobbin. A projection of the voice coil bobbin forms the winding start terminal. A folded portion of the winding end portion of the voice coil forms the winding end terminal. Input signal lead wires on the damper are electrically connected to the winding start and end terminals to drive the cone paper by the voice coil.

11 Claims, 11 Drawing Sheets

VOICE COIL AND LOUDSPEAKER STRUCTURE

BACKGROUND OF THE INVENTION

1. Field of the Invention

The present invention relates to the structure of a voice coil and the structure of a loudspeaker having such a voice coil. More particularly, the invention relates to the structures of a voice coil and a loudspeaker capable of increasing a volume ratio of a conductor to a voice coil and improving a magnetic efficiency.

2. Related Background Art

FIGS. 15 to 20 show the structure of a loudspeaker proposed by the same applicant in Japanese Utility Model Application No.4-26566. FIG. 15 is a cross sectional view showing a half of a loudspeaker, FIG. 16 is a perspective view of showing winding start and end terminals of a voice coil connected to input lead wires adhered to a damper, FIG. 17 is an enlarged side view in section showing a voice coil using a flat wire, FIG. 18 is an enlarged side view in section showing a voice coil using a slit wire, FIG. 19 is a cross sectional view showing a half of a conventional general loudspeaker, and FIG. 20 is a perspective view of a voice coil of the loudspeaker shown in FIG. 19.

Referring to FIGS. 15 to 18, reference numeral 3 generally represents a magnetic circuit which is constituted by two ring magnets 3*a* and 3*b* with the same polarity being faced with each other, and a ring center plate 3*c* made of magnetic material squeezed between the magnets 3*a* and 3*b*. Reference numeral 4 represents a gap formed between the outer periphery of the center plate 3*c* of the magnetic circuit 3 and a voice coil.

Reference numeral 5 generally represents a holder having a cylindrical center guide 5*a* formed at the center of the holder and extending upward from the bottom thereof. A mount hole 5*e* is formed in a mount 5*d* extending outward from the lower end of the center guide 5*a*. Reference numeral 6 represents a mount screw, reference numeral 7 represents a frame of the loudspeaker, and reference numeral 8 represents a diaphragm or cone paper of the loudspeaker.

Reference numeral 9 represents an input terminal, and reference numeral 10 represents a damper which as shown in FIG. 16, is formed with a corrugation 10*a* made of cotton fabric or the like impregnated with phenol resin and thermally molded. Reference numeral 11 represents input signal lead wires made of flat woven tinsel wires sewed on the damper in parallel in a radial direction. Reference numeral 24 represents solder.

Reference numeral 40 represents a voice coil made of a round wire having a winding width A. The winding end portion 40*a* and start portion 40*b* of the voice coil 40 are pulled out at the upper end portion of the voice coil 40. Reference numeral 41 represents an insulating tape or reinforcing paper covering the outer wall of the voice coil 40, reference numeral 42 represents a winding end terminal connected to the winding end portion 40*a*, and reference numeral 43 represents a winding start terminal connected to the winding start portion 40*b*.

In FIG. 17, reference numeral 45 represents another voice coil using a flat coil wire. In FIG. 18, reference numeral 46 represents another conventional voice coil using a so-called slit coil wire.

In the loudspeaker having the voice coil 40 constructed as above, a repulsion magnetic field is generated by the magnets 3*a* and 3*b* magnetized in the thickness direction with the same pole being faced with each other. The repulsion magnetic field is converged to the center plate 3*c* interposed between the magnets 3*a* and 3*b*, and propagated outward from the outer periphery of the center plate 3*c*.

The voice coil 40 spaced from the outer periphery of the center plate 3*c* by the gap 4 is driven by the magnetic field. The inner peripheral portion of the cone paper 8, i.e., a neck portion and a suspension, and the inner diameter portion of the damper 10 or the like are directly coupled to the outer wall of the voice coil 40. The loudspeaker of this type is a direct drive type loudspeaker.

A round wire is generally used as a coil wire. For example, if a round wire having a diameter of the conductive material of 0.4 mm or smaller is used, the voice coil 40 having the predetermined winding width A and a predetermined number of turns has generally two layers or four layers.

The winding end portion 40*a* of the voice coil, i.e., the end portion of the first turn, and the winding start portion 40*b*, i.e., the end portion of the last turn, are pulled upward to the upper end portion of the outer wall of the voice coil 40, and the ends of the end and start portions 40*a* and 40*b* are fixed to the outer wall of the voice coil 40 by the insulating tape 41.

The ends of the end and start portions 40*a* and 40*b* are bonded by solder 24 to a pair of winding end and start terminals 42 and 43 made of, for example, copper foils attached to the insulating tape 41, to thus establish electrical connection therebetween.

As disclosed in Japanese Utility Model Laid-open Publication No.1-42696 by the same applicant, the winding end and start terminals 42 and 43 are bonded by solder 24 to the input signal lead wires 11 made of a flat woven tinsel wire attached to the damper 10, so that an input signal applied to the input terminals 9 of the loudspeaker is supplied via the lead wires 11 to the voice coil 40 to drive the cone paper 8 mounted on the voice coil 40.

The volume ratio of conductive material to the voice coil 40 made of a round wire having the winding width A is about 50%. It is well known that the magnetic efficiency of a loudspeaker can be improved if the volume ratio is improved. Important factors of improving the volume ratio are the cross sectional shape of conductive material of a coil wire, the insulating later of the coil wire, and an adhesive agent used for the coil wire. It is preferable that the ratio of the area occupied by the insulating clad and adhesive agent to the cross sectional area of the conductive material be as small as possible. Conventionally, a coil wire having a cross sectional shape of a rectangle or a square has been used to improve the volume ratio.

FIG. 17 shows a voice coil 45 using a flat wire obtained by rolling a round coil wire, and FIG. 18 shows a voice coil 46 using a slit coil wire obtained by cutting a foil or the like made of conductive material such as copper and aluminum by a slitter or the like. Both the voice coils have been proposed which improve the volume ratio.

Generally, a flat coil wire or slit coil wire is wound to form one layer, and the winding end and start portions of the voice coil 45, 46 are pulled upward and bonded by solder to the winding end and start terminals made of copper foil or the like attached to the outer wall of the voice coil 45, 46.

The volume ratio of the voice coil 45 using a flat wire is about 60%, being improved by about 10% as compared to the voice coil 40 using a round wire. The volume ratio of the voice coil 46 using a slit wire is about 65%, being improved by about 5% as compared to the voice coil 45 using a flat wire.

FIGS. 19 is a cross sectional view showing a half of a conventional loudspeaker having a general magnetic circuit, and FIG. 20 is a perspective view of a conventional voice coil. In FIGS. 19 and 20, like elements to those shown in FIG. 15 are represented by using identical reference numerals, and the description thereof is omitted. Reference numeral 50 represents lead wires connected between input terminals 9 and junction terminals 8*a* on a cone paper 8, and reference numeral 51 represents a yoke.

Reference numeral 52 represents a voice coil using a round coil wire having a winding width A. The winding end portion 52*a* and winding start portion 52*b* of the voice coil 52 are pulled upward to the upper end portion of the voice coil 52. Reference numeral 53 represents a voice coil bobbin, and reference numeral 54 represents an insulating tape or reinforcing paper attached to the outer wall of the voice coil bobbin 53.

A coil wire of the voice coil 52 is generally a round wire. The number of layers of the voice coil 52 using a round wire having the predetermined winding width A and a predetermined number of turns is generally two or four, and the coil is wound about the voice coil bobbin 53 at the lower end portion. The winding end portion 52*a* and winding start portion 52*b* are pulled upward to the upper end portion of the voice coil bobbin on the outer wall thereof.

The volume ratio of the voice coil 52 using a round coil wire of a general loudspeaker constructed as above is substantially the same as the direct drive type loudspeaker described with FIG. 15, and smaller than that of a voice coil using a flat wire or slit wire.

In other conventional loudspeakers improving a magnetic efficiency, a coil wire (generally called an iron core wire) has been used which has core material made of magnetic material such as iron and conductive material such as copper melted and attached to the surface of the core material. A coil wire (generally called a copper core wire) has also been used which has core material made of conductive material such as copper and magnetic material such as iron plated to the surface of the core material.

With the structures of the above-described voice coil using a round wire, however, the volume ratio is low and the magnetic efficiency of the voice coil 40 is low. Even if a flat wire is used to improve the volume ratio, round corners are formed on the flat wire because it is formed by rolling a round wire. The round corners lower the volume ratio.

In the case of a slit wire, although the round corners are not formed, the volume ratio is improved only by about 5%. The smaller the diameter of the conductive material or the thinner the conductive material, the greater the area occupied by the clad insulating layer and adhesive layer and therefore the lower the volume ratio of the conductive material to the voice coil.

In the case of a bobbin-less voice coil using a round wire, flat wire, or slit wire, the area for holding the coil wire itself becomes very small. Therefore, if a large input signal is applied, the characteristics of adhesive agent adhering the coil wire itself are degraded by heat, and the coil wire becomes likely to be peeled off partially by an acceleration speed of the coil. Particularly, in the case of a round wire, the uppermost turn or lowermost turn of the coil wire at the first layer is likely to be peeled off, resulting in a possible breakage of the coil wire.

Also in the case of a voice coil using an iron core wire or the like containing magnetic material, it is obvious that the improved volume ratio is preferable. However, it is difficult to control the amounts and properties of conductive material and magnetic material constituting an iron core wire or a copper core wire.

In a conventional general loudspeaker shown in FIG. 19, a plate for forming a magnetic gap is mounted at the outside of the voice coil. If the outer diameter of the voice coil is too large, the coil cannot be entered in the magnetic gap. If the magnetic gap is made wider, the magnetic efficiency is reduced.

SUMMARY OF THE INVENTION

The present invention has been made to solve the above problems. It is an object of the present invention to provide the structure of a voice coil and the structure of a loudspeaker in which the voice coil is formed by winding a tape wire about a voice coil bobbin a plurality of turns with the upper and lower edges of the tape wire being aligned flush with each other to thereby improve the volume ratio, and the amounts and properties of magnetic material and conductive material of a coil wire are controlled to improve the magnetic efficiency and .realize a high performance loudspeaker.

According to one aspect of the present invention, there is provided the structure of a voice coil in which a tape wire is wound about a voice coil bobbin by a plurality of turns with the upper and lower edges of the tape wire being aligned flush with each other, the tape wire being formed by bonding an insulating layer and an adhesive layer to one plane of a conductive member cut in a tape having a predetermined width.

The width of the tape wire may be made equal to the winding width of a voice coil wound about a voice coil bobbin. A magnetic member may be attached to at least one plane of the conductive member constituting the tape wire, and the magnetic member may be a ferromagnetic member magnetized in a predetermined direction.

According to another aspect of the present invention, there are provided a voice coil bobbin made of conductive material and having partially a protection extending in a winding width direction, and a voice coil whose first layer is electrically connected to the voice coil bobbin, wherein the projection of the voice coil bobbin is folded outward of the voice coil to use it one of two ends of the voice coil.

A predetermined junction gap may be formed in the voice coil bobbin to electrically bond the voice coil bobbin and the first layer of the voice coil by flowing solder into the predetermined junction gap. A hole or recess may be partially formed in the voice coil bobbin to flow solder into the hole or recess to electrically bond the voice coil bobbin and the first layer of the voice coil.

According to a further aspect of the present invention, there is provided a voice coil using a tape wire with its insulating layer facing outward from a voice coil bobbin, the terminal formed on the voice coil bobbin being made in contact with an optional area of the first layer of the voice coil.

A conductive thin plate may be interposed between a voice coil made of insulating material and a voice coil wound about the voice coil bobbin, to thereby electrically connect the voice coil to the thin plate and use the thin plate as a voice coil terminal.

According to a still further aspect of the present invention, there is provided the structure of a voice coil in which a tape wire is wound about a voice coil bobbin by a plurality of turns with the upper and lower edges of the tape wire being aligned flush with each other, the tape wire being formed by bonding an insulating layer and an adhesive layer to one plane of a conductive member cut in a tape having a predetermined width, and a conductive thin plate having a projection extending in the winding width direction is interposed between layers of the voice coil, the projection being folded outward of the voice coil to use it as a voice coil winding start terminal.

The conductive thin plate may be made of copper foil, and the copper foil or tape wire is coated with cream solder to bond it to the first or second layer of the voice coil.

According to another aspect of the present invention, there is provided the structure of a voice coil in which the outermost layer of a voice coil is used as the winding end terminal of the voice coil by folding the end portion of the outermost layer back in the opposite winding direction by a predetermined length to expose the conductive material of a tape wire.

According to another aspect of the present invention, there is provided the structure of a loudspeaker having a magnetic circuit for generating a repulsion magnetic field by disposing two magnets with the same polarity being faced with each other and interposing a magnetic member between the two magnets, a voice coil of a tape wire wound about a voice coil bobbin by a plurality of turns with the upper and lower edges of the tape wire being aligned flush with each other, the tape wire being formed by bonding an insulating layer and an adhesive layer to one plane of a conductive member cut in a tape having a predetermined width, a damper integrally formed with lead wires, and a diaphragm, in which the damper and diaphragm are mounted on the voice coil, and the lead wires are electrically connected to the voice coil.

According to the present invention, a tape wire is used as a voice coil wire wound about a voice coil bobbin a plurality of turns with the upper and lower edges of the tape wire being aligned flush with each other, the tape wire having a predetermined width, i.e., the width same as the winding width necessary for driving a loudspeaker.

The tape wire is formed, for example, by bonding an alumite insulating layer formed on the surface of a conductive layer made of aluminum foil and a heat resisting varnish coated adhesive layer to one plane of the conductive layer. The voice coil bobbin is made of a conductive layer of aluminum foil strip and an adhesive layer formed on the surface of the conductive layer. A projection is formed near at one end of the voice coil bobbin, and the adhesive layer is partially removed at the one end to expose the conductive layer.

The voice coil bobbin is formed in a cylindrical shape. One plane of the voice coil coated with varnish is coated with methanol. The exposed area of the conductive layer is coated with solder. The tape wire is wound about the voice coil bobbin, for example, 130 turns while facing the back or conductive layer toward the outer wall of the bobbin and coating methanol on the varnish containing layer.

In the voice coil of a tape wire wound about the voice coil bobbin, varnish contained in the adhesive layer of the tape wire is reactivated by methanol to firmly adhere the turns of the tape wire.

The winding end portion of the outermost turn of the voice coil is folded to expose the conductive layer. The voice coil is then placed in an oven for 30 minutes at a temperature of 190° C. to remove the varnish on the folded portion. The folded portion is coated with solder to form the winding end terminal. At the same time, the one end of the voice coil bobbin and the winding start portion of the tape wire coated with solder is electrically connected because the solder is melted in the oven.

The conductive layer of the voice coil bobbin is therefore electrically connected to the winding start portion of the voice coil. The projection is folded and made to contact an insulating tape attached to the outer wall of the voice coil. The folded projection is coated with solder to form the winding start terminal of the voice coil.

The winding start and end terminals of the voice coil are electrically connected to the input signal lead wires on the damper directly attached to the voice coil so that the input signal to the loudspeaker input terminals is supplied to the voice coil. The lead wires are flat woven tinsel wires sewed in parallel on the damper along the corrugation. The space between the lead wires is set equal to the space between the winding start and end terminals.

The magnetic circuit uses two neodymium based ring magnets and a center plate interposed therebetween, and is fixed by a holder by using adhesive agent. The two magnets are magnetized in the thickness direction, and disposed with the same polarity being faced with each other to generate a repulsion magnetic field out of the center plate.

The voice coil disposed at the circumferential area of the center plate and spaced therefrom by a predetermined gap is driven by the magnetic field.

In another structure of a voice coil, on the conductive layer of the tape wire, a tape magnetic or ferromagnetic layer having the same width as the conductive layer is attached. The ferromagnetic layer is magnetized in the direction of magnetic fluxes generated by the repulsion magnetic field of the yoke so that a voice coil having an improved magnetic efficiency can be formed.

The winding start terminal of the voice coil may be formed by forming a junction gap of the voice coil bobbin and flowing solder into the gap to electrically connect the voice coil winding start portion and the voice coil bobbin and use the projection as the winding start terminal.

A hole or recess may be formed near the junction gap. Solder is flown into this hole or gap to electrically connect the voice coil bobbin and the voice coil winding start portion and use the projection as the winding start terminal.

A conductive material member such as copper foil is inserted between the voice coil bobbin and the innermost turn of the voice coil. The copper foil and the innermost turn of the voice coil is electrically connected by cream solder or the like. An extended portion of the copper foil is folded to the outer wall of the voice coil to form the winding start terminal.

In the case of a bobbin-less voice coil, a conductive thin plate such as copper foil is inserted between the first and second turns of the voice coil. The copper foil and the first or second turn are electrically connected by cream solder or the like to use an extended portion of the copper foil as the voice coil winding start terminal.

DETAILED DESCRIPTION OF THE PREFERRED EMBODIMENTS

Figure 1:
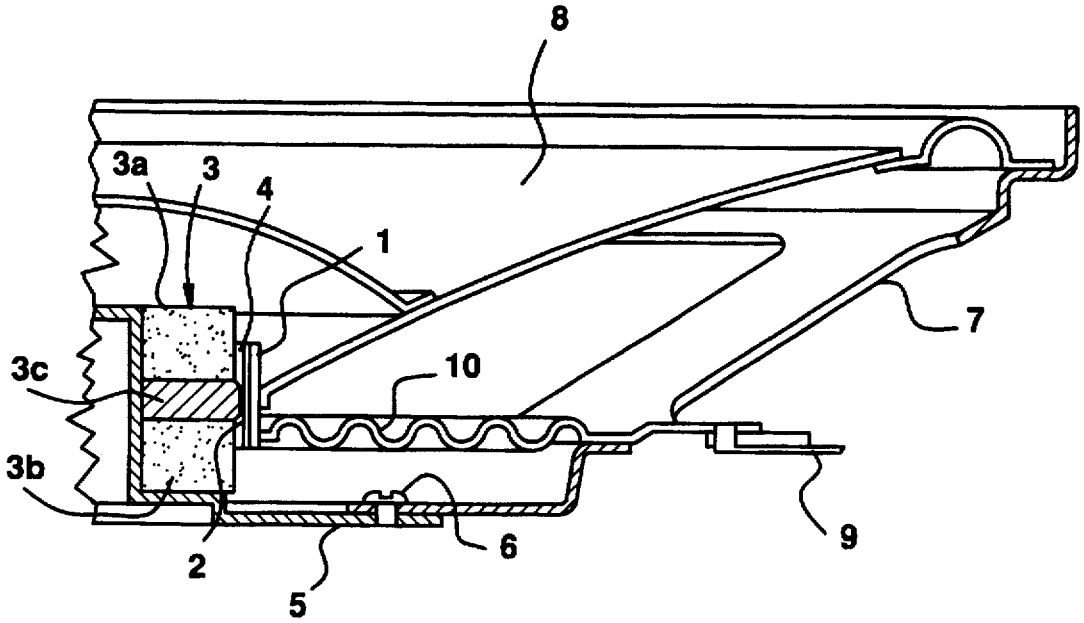
FIG. 1 is a cross sectional view showing the structure of a half of a loudspeaker and a voice coil according to an embodiment of the present invention.

Embodiments of the structures of a voice coil and a loudspeaker having such a voice coil according to the present invention will be described with reference to FIGS. 1 to 14. Like elements to those conventional structures are represented by identical reference numerals and the description thereof is omitted.

Figure 2:
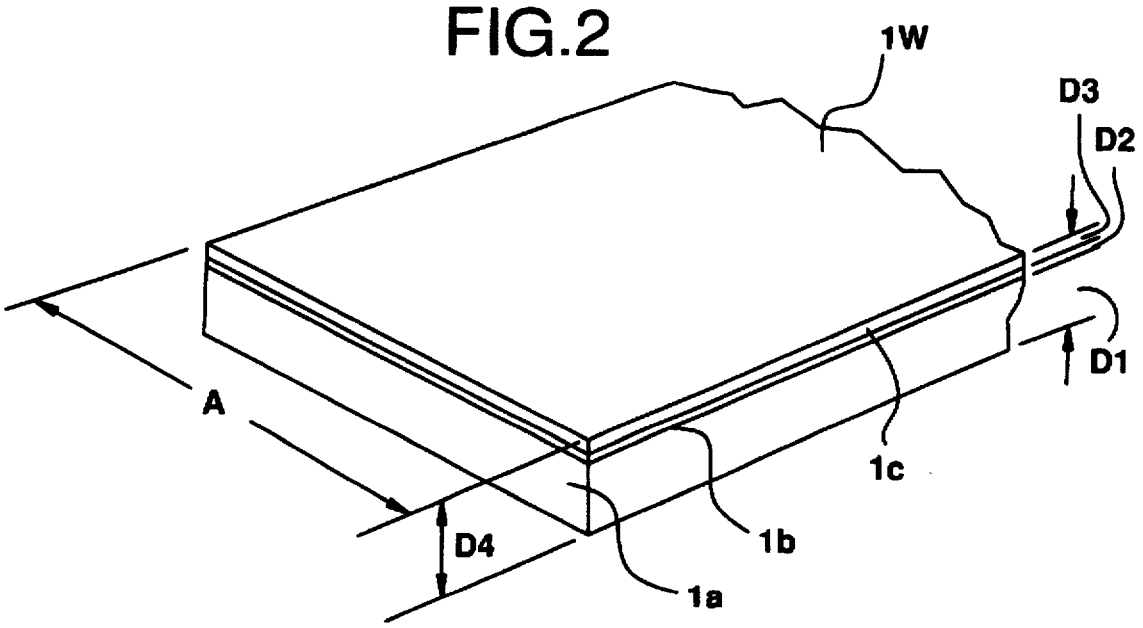
FIG. 2 is an enlarged perspective view showing the structure of a tape coil wire.
Figure 3:
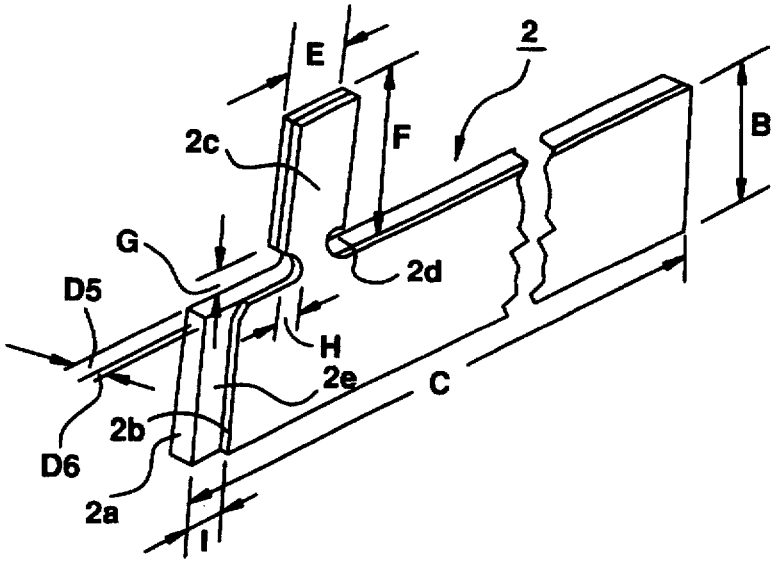
FIG. 3 is a perspective view showing the structure of a voice coil bobbin.
Figure 4:
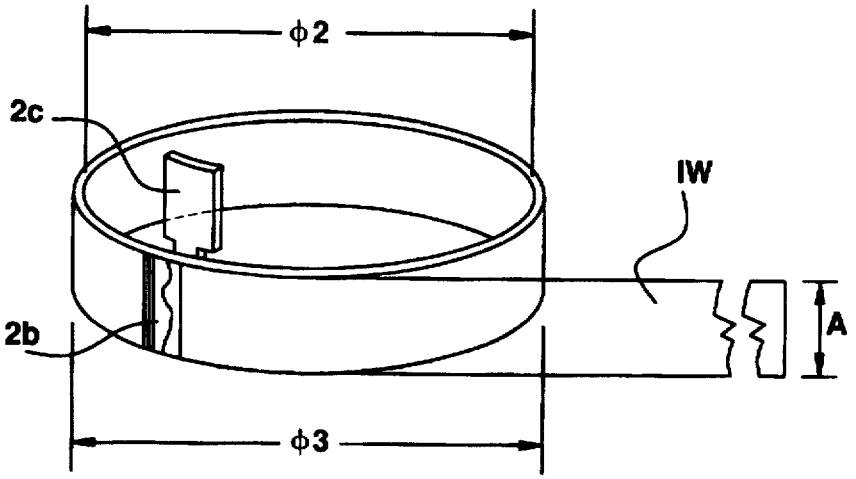
FIG. 4 is a perspective view showing the voice coil bobbin with the winding start portion of a tape wire wound about the bobbin.
Figure 5:
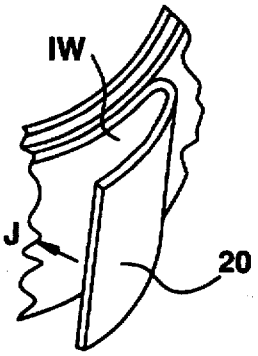
FIG. 5 is an enlarged perspective view showing a folded portion of the winding end portion of the tape wire.
Figure 6:
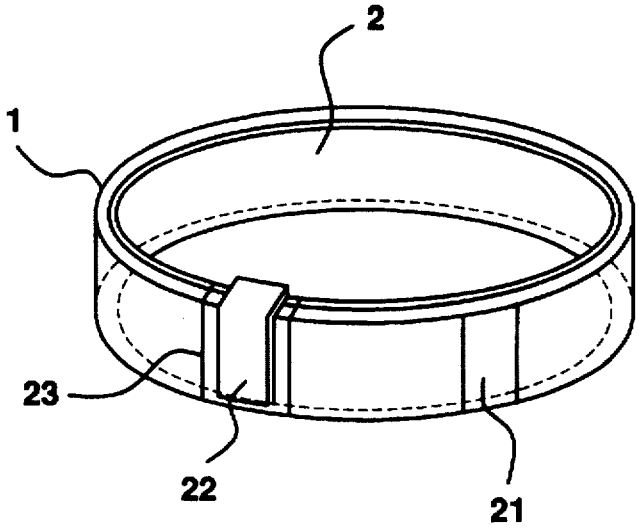
FIG. 6 is a perspective view showing an assembly of a tape wire and a voice coil bobbin.
Figure 7A:
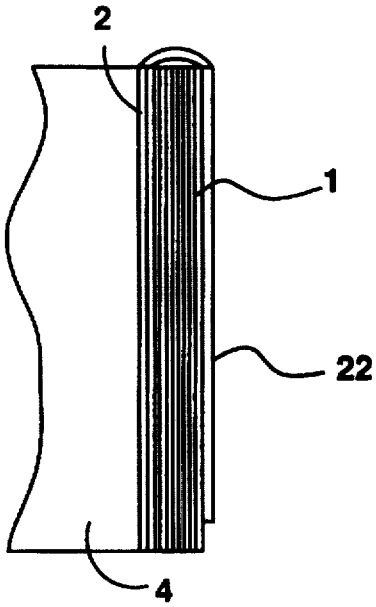
FIG. 7A is an enlarged side view in section showing a voice coil bobbin with a tape wire being wound thereabout.
Figure 7B:
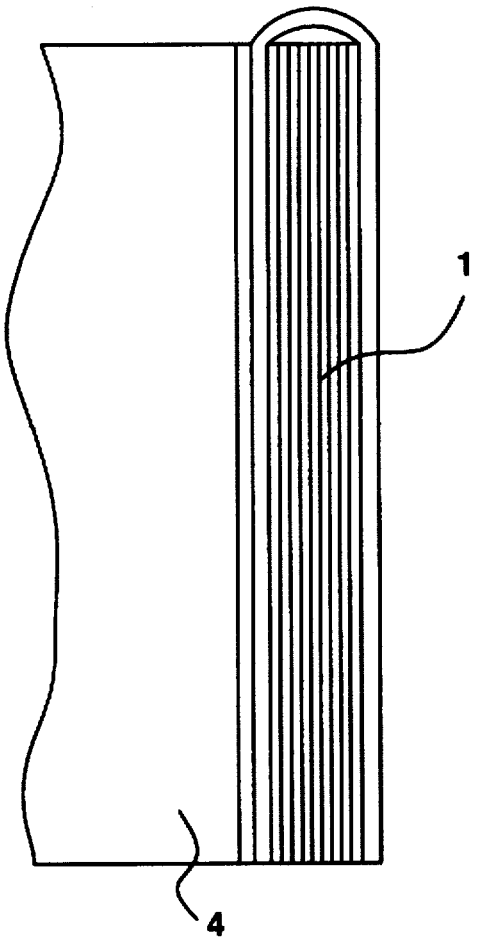
FIG. 7B is an enlarged side view in section showing a bobbin-less voice coil in accordance with the present invention.
Figure 8:
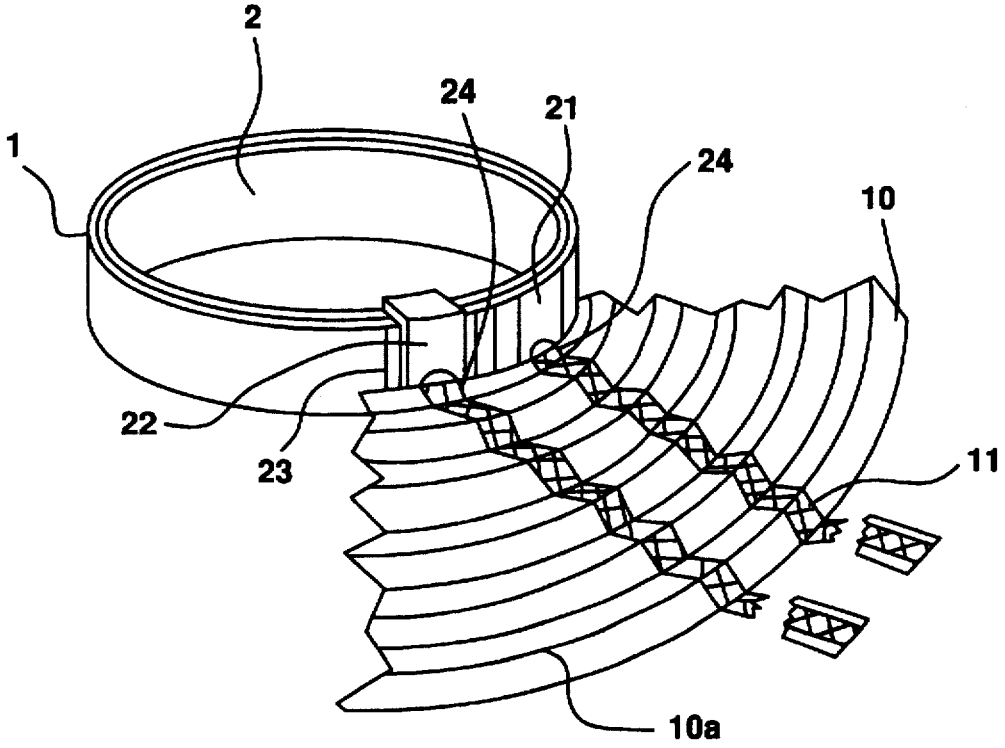
FIG. 8 is a perspective view showing the winding start and end terminals of a voice coil connected to input signal lead wires.
Figure 9:
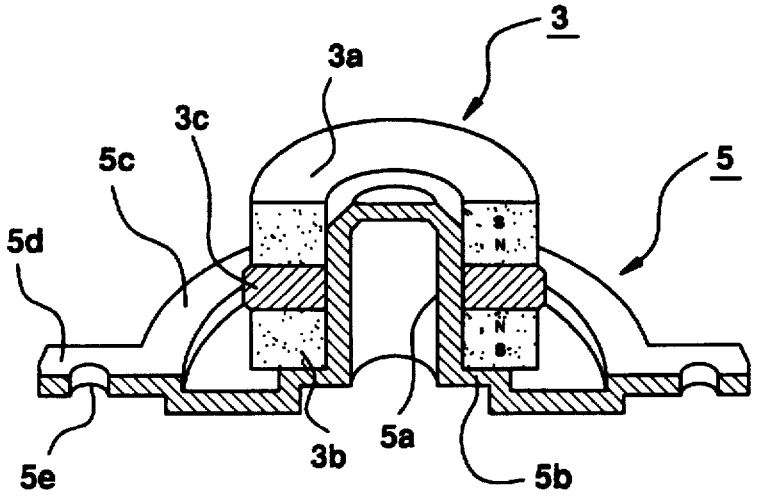
FIG. 9 is a cross sectional view showing an assembly of a magnetic circuit yoke and a holder for holding the yoke.

FIG. 1 is a cross sectional view showing the structure of a half of a loudspeaker, FIG. 2 is an enlarged perspective view showing the structure of a tape coil wire, FIG. 3 is a perspective view showing the structure of a voice coil bobbin, FIG. 4 is a perspective view showing the voice coil bobbin with the winding start portion of a tape wire wound about the bobbin, FIG. 5 is an enlarged perspective view showing a folded portion of the winding end portion of the tape wire, FIG. 6 is a perspective view showing an assembly of a tape wire and a voice coil bobbin, FIG. 7 is an enlarged side view in section showing a voice coil bobbin with a tape wire being wound thereabout, FIG. 8 is a perspective view showing the winding start and end terminals of a voice coil connected to input signal lead wires, FIG. 9 is a cross sectional view showing the structure of a holder for holding a magnetic circuit.

Figure 10:
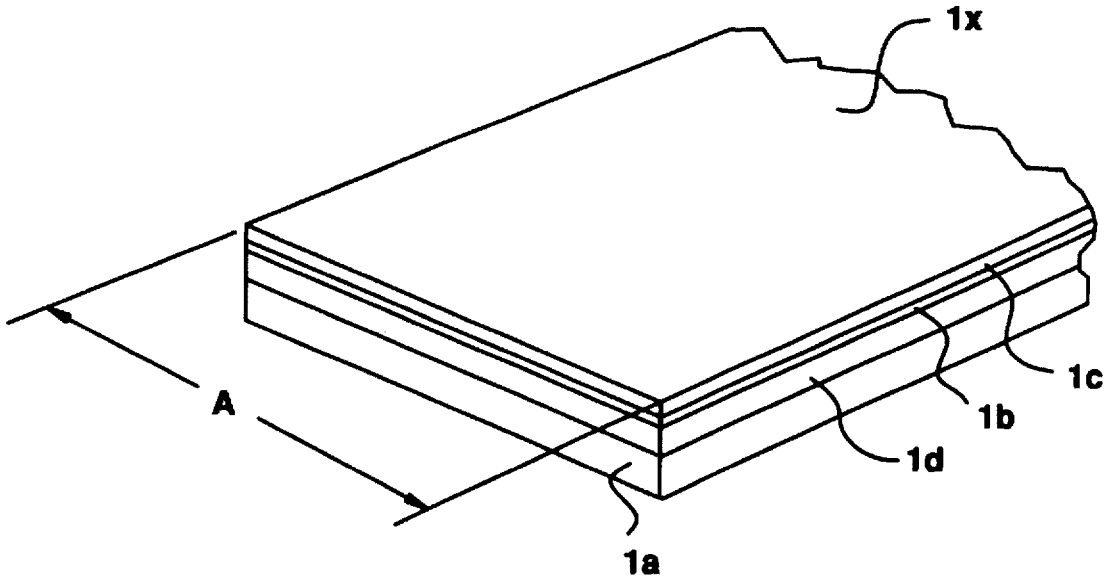
FIG. 10 is an enlarged perspective view showing the structure of a magnetic tape wire according to another embodiment of the invention.
Figure 11:
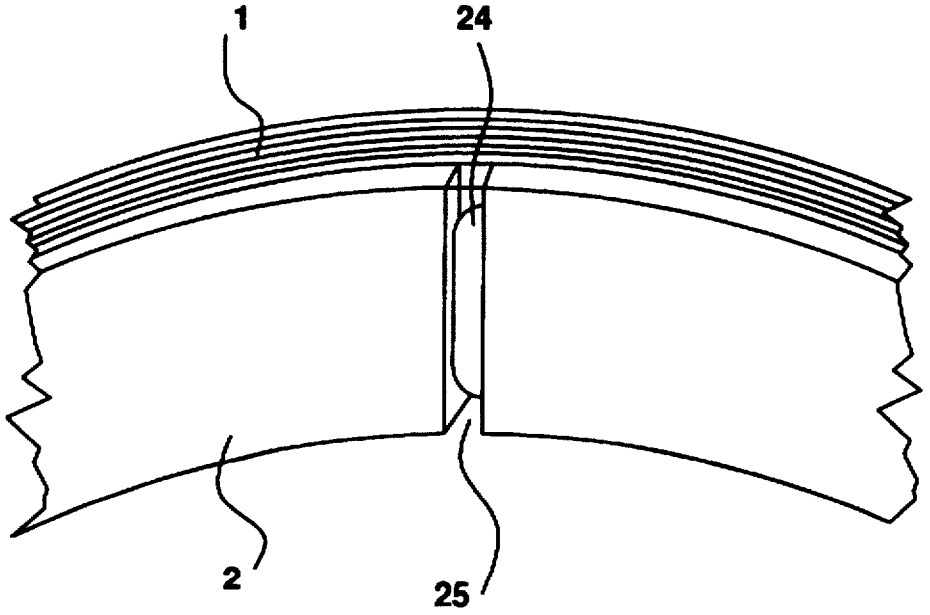
FIG. 11 is an enlarged perspective view showing a connection of the winding start portion of a tape wire by flowing solder into a junction gap of a voice coil bobbin, according to another embodiment of the invention.
Figure 12:
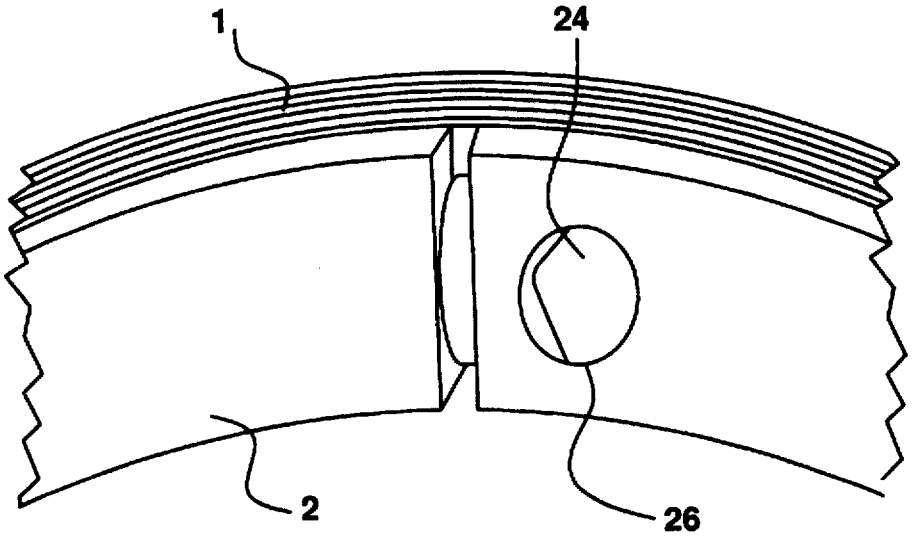
FIG. 12 is an enlarged perspective view showing a connection of the winding start portion of a tape wire by flowing solder into a hole formed near a junction gap of a voice coil bobbin, according to another embodiment of the invention.
Figure 13:
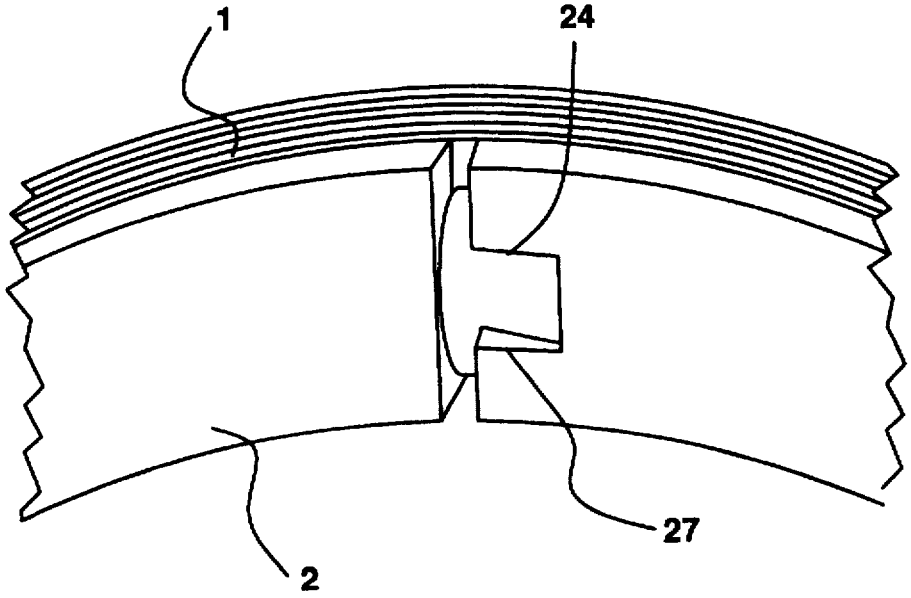
FIG. 13 is an enlarged perspective view showing a connection of the winding start portion of a tape wire by flowing solder into a recess focused near a junction gap of a voice coil bobbin, according to another embodiment of the invention.
Figure 14:
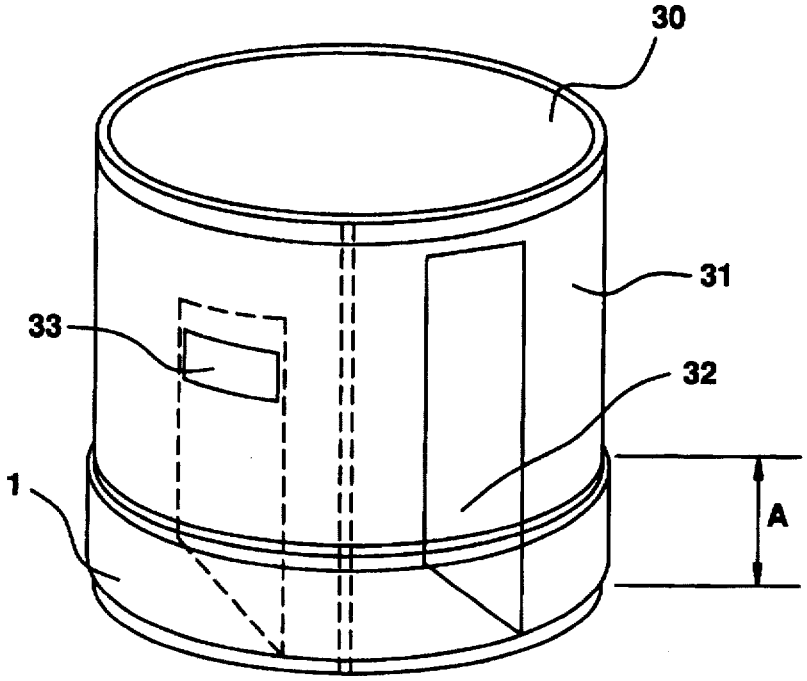
FIG. 14 is a perspective view showing a voice coil wound about a voice coil bobbin according to another embodiment of the invention.
Figure 15:
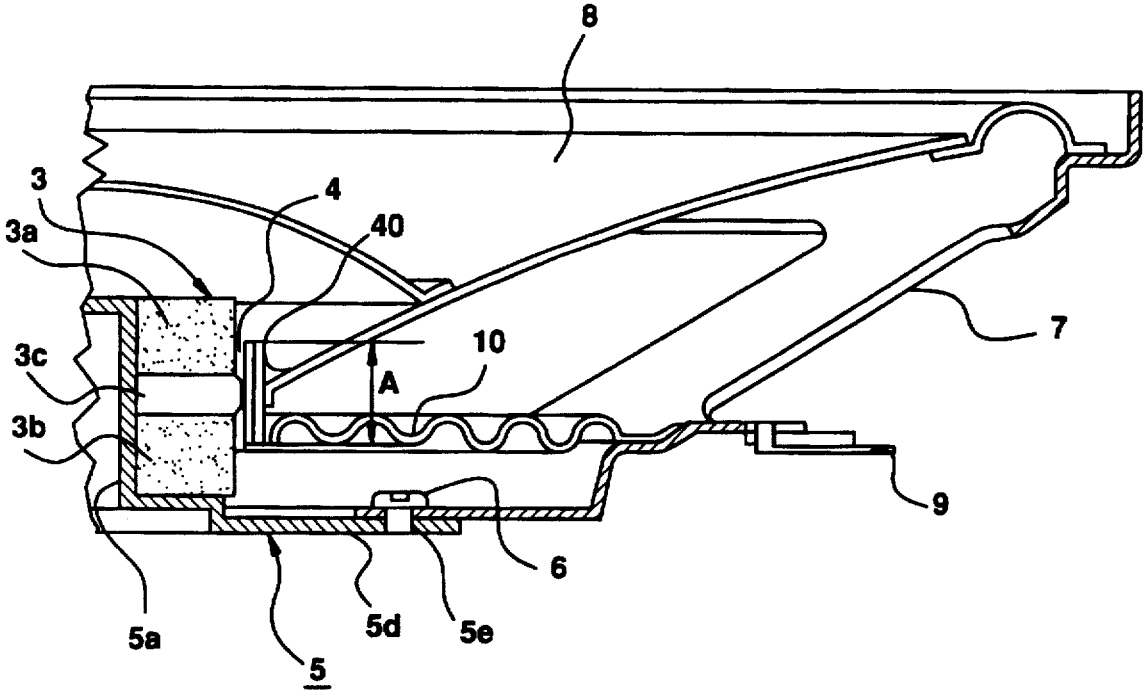
FIG. 15 is a cross sectional view showing a half of a loudspeaker.
Figure 16:
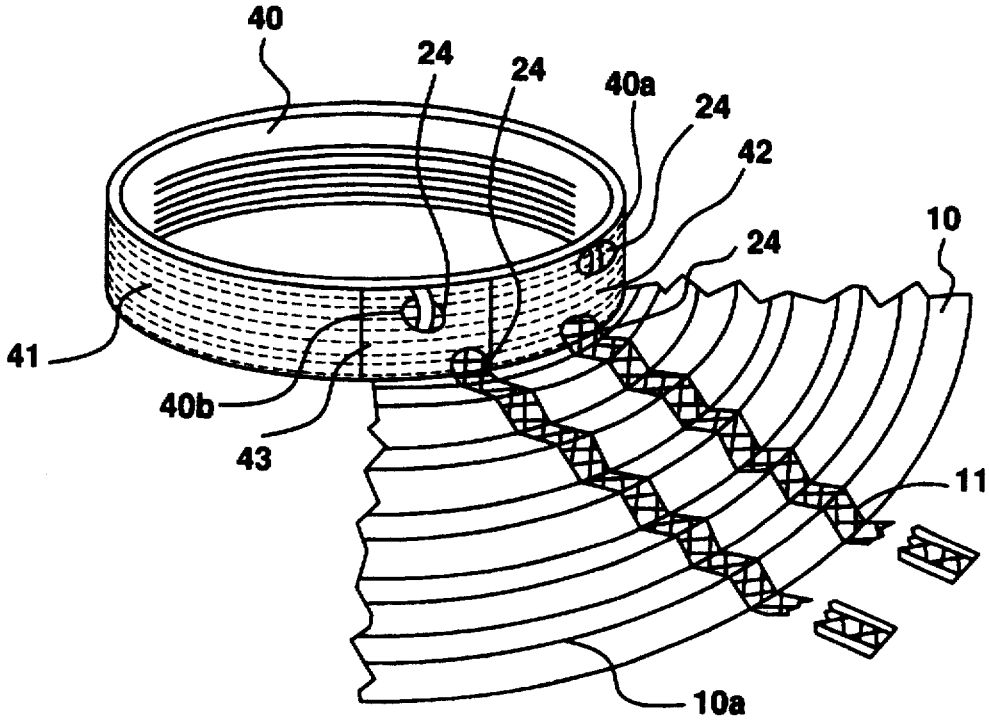
FIG. 16 is a perspective view of showing winding start and end terminals of a voice coil connected to input lead wires adhered to a damper.
Figure 17:
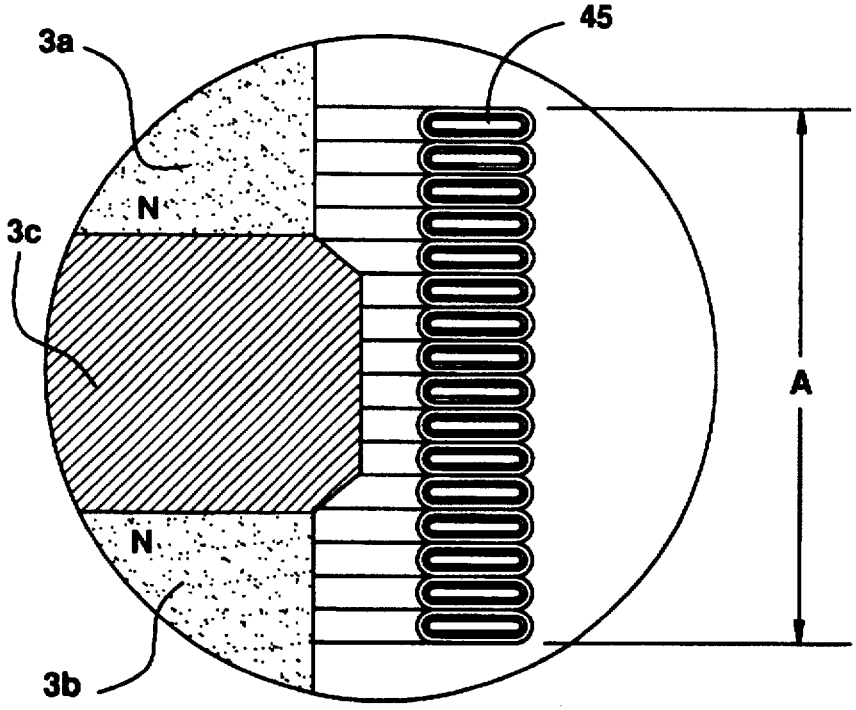
FIG. 17 is an enlarged side view in section showing a voice coil using a flat wire.
Figure 18:
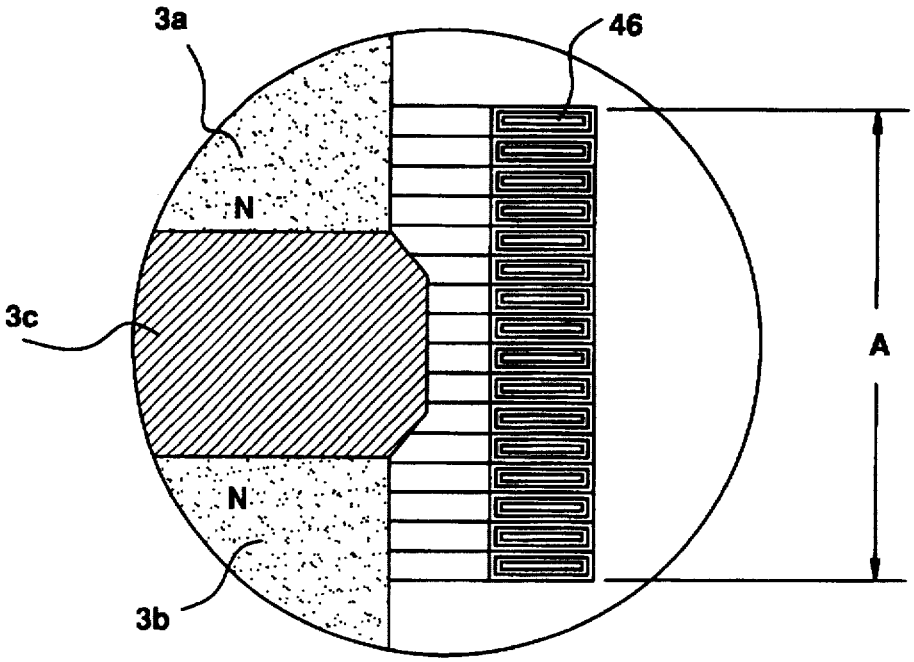
FIG. 18 is an enlarged side view in section showing a voice coil using a slit wire.

FIG. 10 is an enlarged perspective view showing the structure of a magnetic tape wire according to another embodiment of the invention, FIGS. 11 to 13 are enlarged perspective views showing a connection of the winding start portion of a tape wire to a voice coil bobbin by solder, and FIG. 14 is a perspective view showing a voice coil wound about a voice coil bobbin according to another embodiment of the invention.

In the drawings, reference numeral 1 represents a voice coil and reference numeral 1*w* represents a tape coil wire. The tape wire 1*w* is wound on the voice coil bobbin 2 to form the voice coil 1. For example, the tape wire 1*w* has a conductive layer 1*a* made of aluminum foil and having a thickness D1 of about 10μ, an alumite insulating layer 1*b* formed on the surface of the aluminum foil and having a thickness D2 of about 1μ, and an adhesive layer 1*c* made of heat resisting varnish coated on the insulating layer 1*b* and having a thickness D3 of about 2 to 2.5μ. These layers are cut by a slitter into a tape having a width A of 10 mm. The total thickness D4 of the tape wire 1*w* is about 12 to 12.5μ.

If heat resistivity is not necessary, the alumite insulating layer 1*b* and adhesive layer 1*c* may be made of polyurethane or the like.

Reference numeral 2 represents a voice coil bobbin made of aluminum. For example, as shown in FIG. 3, an adhesive layer 2*b* having a thickness D6 of about 10μ is formed on the surface of an aluminum foil 2*a* having a thickness D5 of 0.09 mm, and this bobbin is cut into a strip having a width B of 11 mm and a length C of 110 mm.

A tongue projection 2*c* having a width E of 8 mm and a length F of about 10 mm is formed near one end of the strip bobbin. Two recesses 2*d* having a width of about 1.8 mm and a length of about 2 mm are formed near the bottom of the projection 2*c*. The aluminum foil of the voice coil bobbin 2 is exposed near at one or both ends of the coil by removing the adhesive layer 2*b* by about 1 mm to thereby form an exposed area or areas 2*e*.

Referring to FIGS. 5 to 7, reference numeral 20 represents a folded portion formed by folding the end portion of the outermost layer of the tape wire 1*w* in the J arrow direction. Reference numeral 21 represents a winding end terminal obtained by surface-processing the folded portion 20. Reference numeral 22 represents a winding start terminal formed by bending the projection 2*c* of the voice coil bobbin 2. Reference numeral 23 represents an insulating tape which functions as an insulating layer between the winding start terminal 22 and the outer conductive surface of the voice coil 1.

Referring to FIG. 9, a yoke 3 and a holder 5 have the structures similar to conventional structures. A step 5*b* formed at the bottom of a center guide 5*a* determines the height of magnets 3*a* and 3*b* and a center plate 3*c*. A flange 5*c* of the holder 5 extends outwardly and radially. Four mounts 5*d* are formed on the flange 5*c* at an interval of 90 degrees, and taps 54 are formed in the mounts 5*d*.

The voice coil bobbin 2 is curled to form a cylindrical shape as shown in FIG. 4, disposing the adhesive layer 2*b* to the outside. The voice coil bobbin 2 is mounted on a coil winding jig (not shown). A proper amount of methanol is coated on the outer wall of the voice coil bobbin 2 mounted on the coil winding jig. Cream solder is coated on the exposed area of the tape wire 1*w*. The tape wire is wound about the outer wall of the voice coil bobbin 2 about 130 turns while contacting the conductive layer 1*a* to the outer wall and coating a necessary amount of methanol on the adhesive layer 1*c*, to thus form the voice coil 1.

Methanol is used to reactivate varnish in the adhesive layer 1*c* of the tape wire 1*w*. The reactivated varnish adheres layers of the tape wire 1*w*.

After the tape wire 1*w* has been wound about the voice coil bobbin 2, the end portion of the outermost turn of the tape wire 1*w* is folded in the J arrow direction to form a folded portion 20 which is made in tight contact with the outermost turn of the voice coil 1, with the alumite insulating layer 1*b* of the folded portion 20 being disposed inside and the conductivity layer 1*a* being disposed outside.

The voice coil 1 with the folded portion of the tape wire 1*w* is placed in an oven for about 30 minutes at about 190° C. to cure the varnish. The varnish on the folded area is removed to expose the conductive layer 1*a* on which solder is coated to form a winding end terminal 21 of the voice coil.

Without folding the end portion of the voice coil 1, the insulating layer 1*b* and adhesive layer 1*c* of the outermost turn may be removed by a predetermined length, and the removed area is coated with solder to form the winding end terminal 21. Although varnish is coated on only the adhesive layer 1*c* of the tape wire 1*w*, adhesive layers having a thickness of a half of D3 may be formed on both planes of the tape wire 1*w*.

While the voice coil is placed in the oven, the cream solder is melted so that the exposed area 2*e* of the voice coil bobbin 2 and the conductive layer 1*a* of the tape wire 1*w* are soldered. An insulating tape 23 is attached to the area corresponding to the projection 2*c* of the voice coil bobbin 2, and the projection 2*c* is bent and made in contact with the outermost turn of the voice coil 1.

Because of the recesses of the projection 2*c*, the projection 2*c* can be easily bent and can maintain holding the outermost turn of the voice coil 1. Because the bent projection 2*c* is part of the voice coil bobbin 2 and electrically connected to the first layer of the voice coil, the winding start terminal 22 can be formed by coating solder on the folded projection 2*c*.

The winding end terminal 21 of the folded portion 20 of the voice coil 1 is a positive input signal terminal, and the winding start terminal 22 of the projection 2*c* is a negative input signal terminal. The voice coil 1 of this embodiment has an inner diameter $\phi 2$ of 35.55 mm, an outer diameter $\phi 3$ of 39 mm, and a winding width A Of 10 mm. The voice coil bobbin 2 of this embodiment has a width B Of 11 mm and a d.c. resistance of about 5.4Ω. The calculated volume ratio of the voice coil 1 is about 72% which is much larger than a conventional voice coil.

The winding end and start terminals 21 and 22 may be formed by providing an electrical connection to conductive layers of the innermost turn and outermost turn of the voice coil 1.

Referring to FIG. 9, the yoke 3 and holder 5 have the structures similar to conventional structures. The step 5*b* formed at the bottom of the center guide 5*a* determines the height of the magnets 3*a* and 3*b* and center plate 3*c*. The flange 5*c* of the holder 5 extends outward and radially. The four mounts 5*d* are formed on the flange 5*c* at an interval of 90 degrees, and the taps 54 are formed in the mounts 5*d*.

The magnetic circuit of a loudspeaker is formed by mounting the magnets 3*a* and 3*b* on the holder 5. The magnets 3*a* and 3*b* are neodymium magnets of a ring type magnetized in the thickness direction and having an outer diameter of 34 mm, an inner diameter of 12 mm, and a thickness of 9 mm.

The holder 5 made of aluminum holds the magnets 3*a* and 3*b* and center plate 3*c*. A cylindrical center guide 5*a* is formed at the center of the holder 5 and extends upward from the bottom thereof. The step 5*b* formed at the bottom of the center guide 5*a* provides a positioning function in the vertical direction of the magnets 3*a* and 3*b* and center plate 3*c*. After acrylic based adhesive agent is coated on the step 5*b*, the magnet 3*b* directing its N pole upward is fitted around the center guide 5*a* at the inner wall of the magnet 3*b*. The outer diameter $\phi 6$ of the center guide is set to 11.95 mm so that the magnet 3*b* can be easily fitted around the center guide 5*a*.

The upper surface of the magnet 3*b* fitted around the center guide 5*a* is coated with adhesive agent. The center plate 3*c* is then pressed and fitted around the center guide 5*a* at the inner wall of the center plate 3*c*. The center plate 3*c* made of an iron ring has an outer diameter of 35.55 mm, an inner diameter of 11.95 mm, a thickness of 6 mm, and champhered corners of at the inner and outer walls. The lower surface of the center plate 3*c* becomes in tight contact with the N pole of the magnet 3*b* and fixed thereto.

Adhesive agent is coated on the upper surface of the center plate 3*c* pressed and fitted around the center guide 5*a*. The magnet 3*a* with its N pole directing upward is fitted around the center guide 5*a* at the inner wall of the magnet 3*a*. The magnet 3*a* becomes in tight contact with the upper surface of the center plate 3*c* and fixed thereto.

Under the condition that the magnets 3*a* and 3*b* and center plate 3*c* are fixedly mounted by the holder 5, the N poles of the magnets 3*a* and 3*b* face with each other and the outer circumference of the center plate 3*c* squeezed between the magnets 3*a* and 3*b* extends outward of the outer circumference of the magnets 3*a* and 3*b* by about 0.775 mm.

The holder 5 with the magnetic circuit is mounted on a frame 7. The holder 5 has the flange 5*c* having a width of 2 mm and a thickness of 2.5 mm. The flange 5*c* has the four mounts 5*d* at the angle pitch of 90 degrees, each mount being formed with a tapped mount hole.

Four holes (not shown) having a diameter of 4.5 mm are formed in the bottom of the frame at the positions corresponding to the tapped mount holes of the holder 5. After rubber based adhesive agent is coated on the flange 5*c* of the holder 5, the holes of the frame 7 are aligned with the four tapped mount holes 5*e* to fix the holder 5 to the frame 7 by using screws 6 having a diameter of 4 mm.

A damper 10 is adhered to the voice coil 1 mounted on the magnetic circuit having the fixed magnets 3*a* and 3*b* and center plate 3*c*. The damper 10 with a corrugation 10*a* and the like is formed by impregnating thermosetting resin such as phenol into a fabric and thermally molding it. Two flat woven tinsel lead wires 11 are sewed on the damper corrugation 10*a* in the radial direction, the space between the two lead wires 111 being equal to the space between the winding end and start terminals 21 and 22 of the voice coil 1.

As shown in FIG. 8, in mounting the inner circumferential area of the damper 10 on the outer circumferential area of the voice coil 1, the winding end and start terminals 21 and 22 on the outer circumference of the voice coil are position aligned with the ends of the two flat woven tinsel lead wires 11 extending near the inner circumferential area of the damper 10. After the damper 10 is placed at a proper position, the winding end and start terminals 21 and 22 are connected by solder 24 to the two lead wires 11 at the inner circumferential area of the damper 10.

Adhesive agent is coated on the outer circumference of the voice coil and the inner circumference of the damper 10. The neck portion of the cone paper 8 is inserted and coated with adhesive agent to adhere the voice coil 1, cone paper 8, and damper 10. The solder 24 is coated with adhesive agent to complete a direct drive type loudspeaker.

In the above embodiment, the voice coil 1 is formed by using the conductive layer 2*a* of the voice coil bobbin 2. Without using the conductive layer 2*a*, insulating material may be used for the voice coil bobbin presenting the same advantageous effects. For example, a voice coil bobbin made of a heat resisting film may be used. In this case, all the surface or only a necessary area is provided with a conductive layer such as copper foil.

FIGS. 10 to 14 show another embodiment of a tape wire 1*w* according to the present invention. In FIG. 10, reference numeral 1*x* represents a magnetic tape wire, and reference numeral 1*d* represents a magnetic material. In the magnetic tape wire 1*x*, varnish mixed with powders of the magnetic material 1*d* such as ferromagnetic material or soft magnetic material is coated on a conductive layer 1*a* of the tape wire 1*x*.

In place of the tape wire 1*w* of the voice coil 1, the magnetic tape wire 1*x* can be used resulting in an improved magnetic efficiency of the voice coil.

The magnetic tape wire 1*x* may be formed by pressure contacting conductive material such as copper to the magnetic material 1*d* such as iron. The magnetic tape wire 1*x* may be formed by attaching the magnetic material 1*d* such as iron to conductive material such as copper by means of plating or evaporation. Further, the magnetic tape wire 1*x* may be formed by attaching a tape of the magnetic material 1*d* such as iron to conductive material such as copper. Furthermore, in the case of ferromagnetic material attached to conductive material, the ferromagnetic material of the voice coil 1 is magnetized in the radial direction, i.e., in the direction same as the direction of magnetic fluxes radiated from the repulsion magnetic field converged to the center plate 3*c* of the magnetic circuit 3. In this manner, it is possible to raise the magnetic flux density in the conductive layer 1*a* and further improve the magnetic efficiency.

FIGS. 11 to 13 show other embodiments of a connection between the winding start end portion of the voice coil and the end portion of the voice coil bobbin 2. In FIGS. 11 to 13, reference numeral 24 represents solder, reference numeral 25 represents a junction gap of the cylindrical voice coil bobbin 2, reference numeral 26 represents a hole formed near the junction gap of the voice coil bobbin 2, and reference numeral 27 represents a recess formed near the junction gap of the voice coil bobbin 2.

Solder 24 is flown in the junction gap 25 of the voice coil bobbin 2 to electrically connect the conductive layer 2*a* of the voice coil bobbin 2 to the winding start end portion of the voice coil 1, i.e., the conductive layer 1*a* of the first turn. Similarly, solder 24 is flown into the hole 26 and recess 27 formed near the junction gap 25 to electrically connect the conductive layer 2*a* of the voice coil bobbin 2 to the conductive layer 1*a* at the winding start end portion of the voice coil 1.

By electrically connecting the voice coil bobbin 2 to the voice coil 1 in the above manner, it is possible to make the projection 2*c* of the voice coil bobbin 2 as the winding start terminal 22 of the voice coil, as described earlier.

Referring to FIG. 7B, if the voice coil bobbin 2 is not used, i.e., if a bobbin-less voice coil is used, a conductive material thin plate 60 such as copper foil coated with cream solder is inserted between the first 62 and second 64 turns of the voice coil 1. The copper foil extending from the upper end 66 of the voice coil 1 is folded outward of the voice coil 1 to form the winding start terminal 22' of the voice coil 1 like the projection 2*c*.

Figure 19:
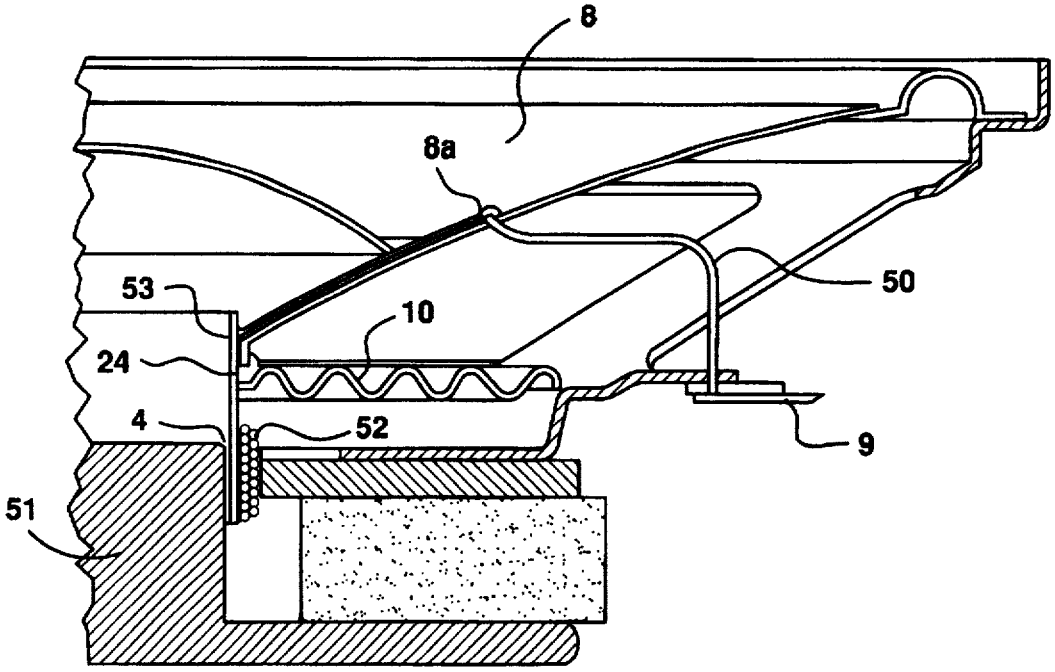
FIG.19 PRIOR ART
FIG. 19 is a cross sectional view showing a half of a conventional general loudspeaker.
Figure 20:
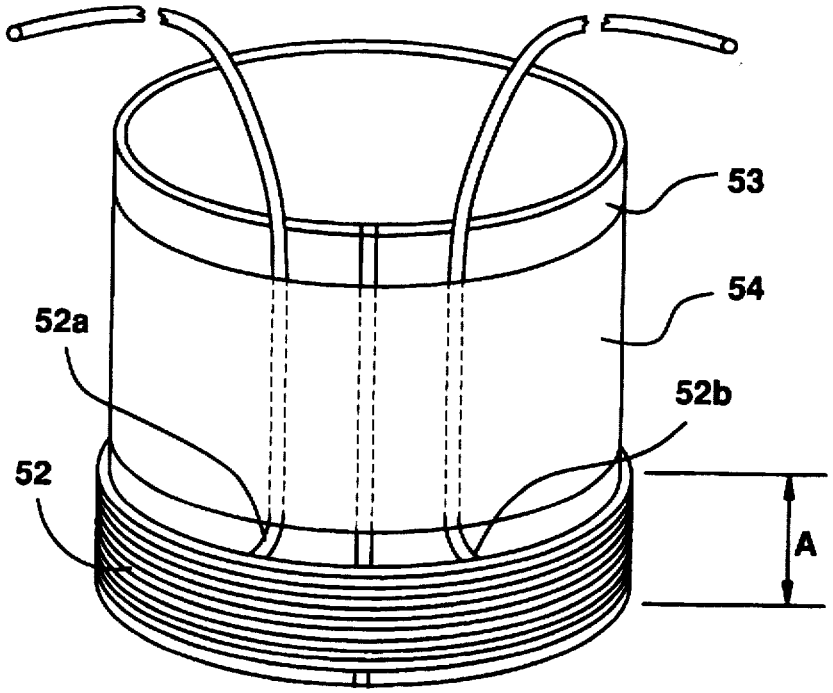
FIG.20 PRIOR ART
FIG. 20 is a perspective view of a voice coil of the loudspeaker shown in FIG. 19.

FIG. 14 shows another embodiment wherein the tape wire 1*w* of this invention is used for a general conventional loudspeaker such as shown in FIG. 19. In FIG. 19, reference numeral 30 represents a voice coil, reference numeral 31 represents an insulating tape or reinforcing paper, reference numeral 32 represents a winding end terminal formed by folding the winding end portion of the tape wire 1*w*, and reference numeral 33 represents a winding start terminal of the tape wire 1*w*.

The voice coil bobbin 30 is covered with the insulating tape 31. The tape wire 1*w* having a tape width A is wound about the voice coil bobbin 30 near at the lower area thereof to form the voice coil 1. The winding end and start portions of the tape wire 1*w* are spaced apart by a predetermined distance, folded and extended to the upper area of the voice coil bobbin 30, and fixed by adhesive agent.

The folded winding start portion is placed inside the insulating tape 31 and extended out of a recess formed in the insulating tape 31 at a predetermined position to thereby form the winding start terminal 33. The folded winding end portion is placed outside the insulating tape 31 and the winding end terminal 32 is formed. The positions of the winding start and end terminals 33 and 32 correspond to the positions of the lead wires on the cone paper 8 adhered to the insulating tape 31 of the voice coil bobbin 30. The winding start and end terminals 33 and 32 are soldered to the lead wires on the cone paper 8.

Even with the general structure of a loudspeaker constructed as above, the voice coil 1 made of the tape wire 1*w* or magnetic tape wire 1*x* can improve the volume ratio. In order to insert the voice coil 1 with the voice coil bobbin 30 into the gap 4 of the general loudspeaker magnetic circuit, it is necessary to set the thickness D1 of the conductive layer 1*a* of the tape wire 1*w* to 5μ or thinner.

As described so far, according to the structure of a voice coil and the structure of a loudspeaker using such a voice coil, a tape coil wire or a magnetic tape coil wire is used for a voice coil. Accordingly, it is possible to increase the volume ratio up to about 70% which is higher than a conventional voice coil using a round wire, flat fire, and slit wire by 7% to 22%.

The winding start terminal of the voice coil is extended to the outer wall of the voice coil, and the winding end terminal is disposed on the outer wall of the voice coil. Accordingly, it is possible to realize the structure of a voice coil which is very effective to a repulsion magnetic circuit type loudspeaker, particularly, a loudspeaker without any magnetic pole outside the voice coil and without any magnetic gap.

The input signal lead wires of a loudspeaker can be soldered to the winding start and end terminals on the outer wall of the voice coil. Accordingly, the wiring work is easy and an assembly of a loudspeaker can be performed without lowering productivity.

Since the tape coil wire is used for a voice coil, the contact area of the tape coil wire becomes large, providing a structure resistive to an acceleration speed of the voice coil in the amplitude direction and basically free from peel-off of the coil wire. A reliability can be improved even for a bobbin-less voice coil.

In the case of a tape wire with magnetic material attached thereto, the magnetic material in the voice coil improves the magnetic efficiency of the loudspeaker. Because it is easy to control the amount of magnetic material, loudspeakers suitable for particular usages can be easily manufactured.

Other advantages are that the structure is simple, cost effective, and easy to realize.

What is claimed is:

1. A loudspeaker comprising:

a voice coil bobbin made of a conductive member at least partially and having a projection extending in a winding width direction;

a voice coil mounted on said voice coil bobbin, and a magnetic circuit for generating a repulsion magnetic field by disposing two magnets with the same polarity being faced with each other and interposing a magnetic member between said two magnets wherein said projection of said voice coil bobbin is folded outward of said voice coil to use said projection as a winding start end terminal, and wherein said voice coil is formed by winding a tape wire about said voice coil bobbin by a plurality of turns with the upper and lower edges of said tape wire being aligned flush with each other, said tape wire being formed by bonding an insulating layer and an adhesive layer to one plane of a conductive member and the end of the most inner turn of said tape wire being connected to said voice coil bobbin.

2. A loudspeaker according to claim 1, wherein the width of said tape wire is made equal to the winding width of said tape wire wound about said voice coil bobbin.

3. A loudspeaker according to claim 1, wherein a predetermined junction gap is formed in said voice coil bobbin to electrically bond said voice coil bobbin and the end of the most inner turn of said tape wire by flowing solder into said predetermined junction gap.

4. A loudspeaker according to claim 1, wherein a hole is partially formed in said voice coil bobbin to flow solder into said hole to electrically bond said voice coil bobbin and the end of the most inner turn of said taper wire.

5. A loudspeaker according to claim 1, wherein a recess is partially formed in said voice coil bobbin to flow solder into said recess to electrically bond said voice coil bobbin and the end of the most inner turn of said tape wire.

6. A loudspeaker according to claim 1 further comprising:

a damper integrally formed with lead wires; and a diaphragm, wherein which said damper and said diaphragm are mounted on said voice coil, and said lead wires are electrically connected to said voice coil.

7. A loudspeaker according to claim 1, wherein a magnetic material is attached to at least one plane of the conductive member constituting said tape wire.

8. A loudspeaker according to claim 7, wherein said magnetic member is a ferromagnetic member magnetized in a predetermined direction.

9. A loudspeaker comprising a bobbinless voice coil wherein which a tape wire is wound by a plurality of turns with the upper and lower edges of said tape wire being aligned flush with each other, said tape wire being formed by bonding an insulating layer and an adhesive layer to one plane of a conductive member, and a conductive thin plate having a projection extending in the winding width direction is interposed between layers of said voice coil, said projection being folded outward of said voice coil wire to use said folded portion as a winding start end terminal, including a magnetic circuit for generating a repulsion magnetic field by disposing two magnets with the same polarity being faced with each other and interposing a magnetic member between said two magnets.

10. A loudspeaker according to any one of claims 1 or 9, wherein the outermost layer of said voice coil is used as the terminating end of said voice coil.

11. A loudspeaker according to claim 10, wherein the outermost layer of said voice coil is used as the terminating end of said voice coil by folding the end portion of said outermost layer back in the opposite winding direction by a predetermined length to expose the conductive material of said tape wire.

* * * * *